US005752403A

United States Patent [19]

Tippins et al.

[11] Patent Number: 5,752,403

[45] Date of Patent: May 19, 1998

[54] METHOD OF ROLLING HOT MILL BAND ON A TWIN STAND REVERSING MILL

[75] Inventors: George W. Tippins; John E. Thomas, both of Pittsburgh, Pa.

[73] Assignee: Tippins Incorporated, Pittsburgh, Pa.

[21] Appl. No.: 669,999

[22] Filed: Jun. 25, 1996

Related U.S. Application Data

[63] Continuation-in-part of Ser. No. 371,137, Jan. 11, 1995.

[51] Int. Cl.[6] ..... B21B 41/00; B21B 41/06

[52] U.S. Cl. ..... 72/229; 72/227

[58] Field of Search ..... 72/229, 227, 226, 72/202, 200, 234, 235; 29/527.7

[56] References Cited

U.S. PATENT DOCUMENTS

| | | | |
|---|---|---|---|
| 372,747 | 11/1887 | Everson . | |
| 1,964,503 | 6/1934 | Coryell | 80/32 |
| 2,025,002 | 12/1935 | McIlvried | 29/18 |
| 2,123,291 | 7/1938 | Smitmans | 80/33 |
| 3,331,232 | 7/1967 | King | 72/365 |
| 3,485,077 | 12/1969 | Wilson | 72/229 |
| 4,497,191 | 2/1985 | Langer et al. | 72/202 |
| 4,580,428 | 4/1986 | Brettbacher et al. | 72/226 |
| 4,745,556 | 5/1988 | Turley | 364/472 |
| 4,793,169 | 12/1988 | Ginzburg | 72/240 |
| 4,958,677 | 9/1990 | Kimura | 164/452 |
| 5,133,205 | 7/1992 | Rostik et al. | 72/200 |
| 5,140,837 | 8/1992 | Thomas et al. | 72/229 |
| 5,276,952 | 1/1994 | Thomas et al. | 29/527.7 |
| 5,437,089 | 8/1995 | Salganik et al. | 29/527.7 |
| 5,511,303 | 4/1996 | Tippins et al. | 29/527.7 |

FOREIGN PATENT DOCUMENTS

| | | | |
|---|---|---|---|
| 178107 | 10/1984 | Japan | 72/229 |
| 918005 | 2/1963 | United Kingdom . | |

OTHER PUBLICATIONS

Sendzimir, Michael G., "Hot strip mills for thin slab continuous casting systems", *Iron and Steel Engineer*, Oct. 1986, pp. 36–43.

Buch, E. et al., "Continuous thin slab casting—direct rolling. Why the planetary hot strip mill?", presented at Iron and Steel Society, Inc., May 1987.

*Primary Examiner*—Lowell A. Larson
*Assistant Examiner*—Rodney Butler
*Attorney, Agent, or Firm*—Webb Ziesenheim Bruening Logsdon Orkin & Hanson, P.C.

[57] ABSTRACT

A method of hot rolling steel slabs of thin to standard thickness into hot mill band is carried out on a hot reversing mill having a coiler furnace upstream and downstream of the reversing mill. A twin stand hot reversing mill is used and the slab is introduced into the first stand of the mill without any breakdown pass. Flat passes of the slab back and forth through the first stand and the second stand occur to form an intermediate product having a thickness capable of being coiled. Thereafter, the intermediate product is coiled on one of the upstream or downstream drums. The product is then passed back and forth between the first and second stand in tandem. An edging stand is positioned between the reversing stands to edge the product during the flat passes. The final product is removed from the hot mill band in one of sheet, plate or coil form.

6 Claims, 1 Drawing Sheet

METHOD OF ROLLING HOT MILL BAND ON A TWIN STAND REVERSING MILL

CROSS REFERENCE TO-RELATED APPLICATION

This is a continuation-in-part of copending U.S. patent application Ser. No. 08/371,137, filed on Jan. 11, 1995.

BACKGROUND OF THE INVENTION

1. Field of the Invention

This invention relates to the rolling of hot mill band and more particularly to the rolling of hot mill band from thin to standard size slabs on a twin stand hot reversing mill having a coiler furnace on each side thereof.

2. Description of the Prior Art

In our copending application directed to a method of rolling light gauge hot mill band on a hot reversing mill, we disclose a preferred method for rolling light gauge hot mill band on the order of 0.040" through the use of a twin stand hot reversing tandem mill having coiler furnaces on either side thereof.

In U.S. Pat. No. 5,511,303, issued Apr. 30, 1996 and filed on even date with the above-identified parent application, we also disclose a twin stand hot reversing mill. In this patent, the twin stand hot reversing mill is inline with an intermediate thickness caster and a vertical edger mill is positioned intermediate the two hot reversing stands. It is also disclosed that in addition to introducing inline intermediate thickness slabs from a continuous caster, outsource slabs, which may have a thickness greater than that cast on the intermediate thickness caster, may be introduced into the processing line.

Others have disclosed twin stand mills, but these mills are either operated independently and not in a twin reversing mode or require a roughing mill upstream of the twin stand mill and/or additional finishing stands downstream of the twin stand hot reversing mill. Representative of these teachings are U.S. Pat. Nos. 4,497,191; 3,331,232; 4,494,395 and British Patent Specification No. 918,005.

The need remains for a hot rolling method which will accommodate the many slab sizes that are now available for hot rolling and produce a wide range of product mix including substantially varying chemistries and substantially varying thicknesses and widths. All of this must be accomplished with a reasonable capital expenditure and a production capacity to assure a reasonable return on the investment.

SUMMARY OF THE INVENTION

Our invention is a method of hot rolling steel slabs of intermediate and/or standard thickness into hot mill band. The method utilizes a twin stand hot reversing mill preferably having a vertical edger positioned therebetween and having upstream and downstream coiler furnaces inline with the twin stand hot reversing mill. The slabs are introduced directly into the first stand of the twin stand without any previous breakdown pass. The slab is flat passed back and forth through the twin stand hot reversing mill with the individual stands working in tandem. The flat passes continue until an intermediate product having a thickness capable of being coiled is formed. The intermediate product is then passed back and forth through the hot reversing mill in tandem and between the upstream and downstream coilers. The reduction of the intermediate product is continued until the hot mill band of the desired thickness is formed. Thereafter, the hot mill band is passed through a finishing area where it is removed from the hot mill in either sheet, plate or coil form.

DESCRIPTION OF THE PREFERRED EMBODIMENT

Figure 1:
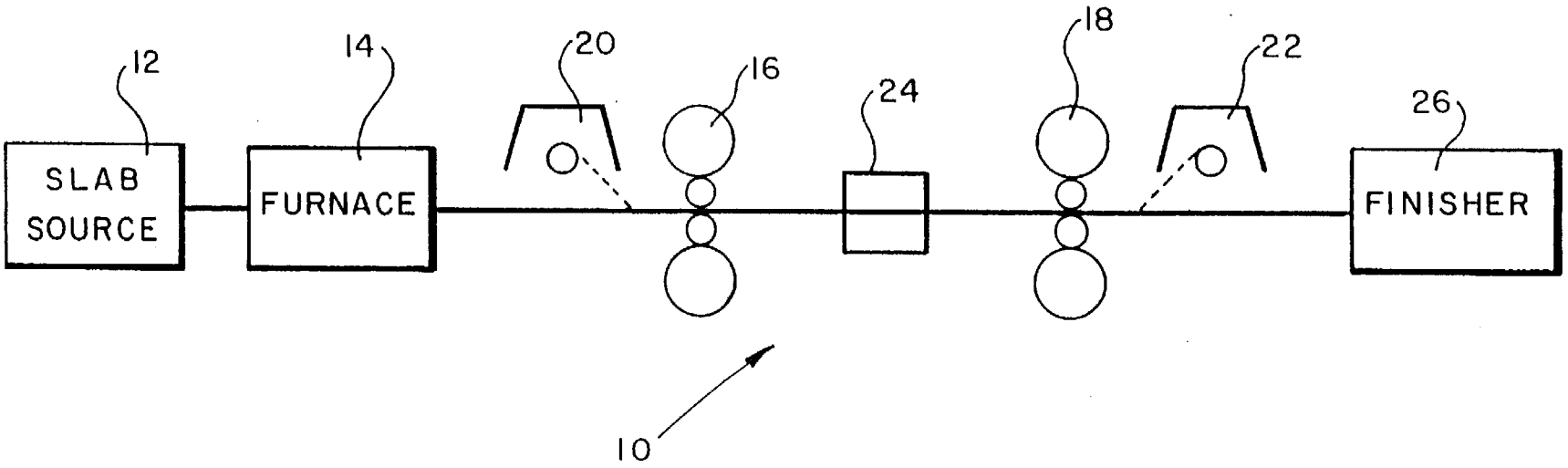
FIGURE 1 is a schematic showing the twin stand hot reversing mill processing line where the method is being carried out.

The general arrangement of the hot mill 10 is illustrated in FIGURE 1. The mill 10 includes a pair of four high hot reversing mill stands 16 and 18, each having a pair of backup rolls and a pair of work rolls. A coiler furnace 20 is positioned upstream of the mill stand 16 and a coiler furnace 22 is positioned downstream of the mill stand 18. Each coiler furnace 20 and 22 includes a drum about which the product being rolled is coiled once it has been reduced to a thickness capable of being coiled.

A slab source 12 consisting of a continuous caster and/or a slabbing mill and/or an outsource of supply is provided. The slabs can be of a thin slab thickness or an intermediate slab thickness or a standard slab thickness. By thin slab thickness, we mean on the order of about 2 inches or less. By intermediate slab thickness, we mean a slab generally on the order of greater than 3 inches and up to about 6 inches and by a standard slab, we mean a slab having a thickness of 6 to 10 inches. The slabs are fed into a reheat and/or soaking furnace 14 where they are brought to the appropriate hot rolling temperature and temperature homogeneity. The slab is then introduced along the pass line into the first hot reversing mill stand 16 and then subsequently into the second hot reversing mill stand 18. The slab is passed back and forth through mill stands 16 and 18 in a series of flat tandem passes until the slab has been reduced to an intermediate product having a thickness capable of being coiled. During the flat passes, the slab is subjected to the vertical edger 24. Vertical edger 24 is intended to be used conventionally or to taper the leading and trailing ends, respectively, of the slab on the first pass through the mill stands 16 and 18 so as to compensate for the flaring of the extreme ends which occurs during subsequent rolling. Such tapering can be controlled by the Automatic Gauge Control (AGC) and the vertical edger 24 can be passively driven by the twin mill stands 16 and 18 of the mill 10. The effectiveness of the tapered ends can be monitored by a width gauge at the exit end of the downstream hot reversing stand 18 wherein a fingerprint of the width is taken and adjustments are made through a feedback loop to the vertical edger 24, where necessary. Generally, the vertical edger 24 is used on flat passes until a thickness of about 2 inches is achieved.

The intermediate product, when it has achieved a thickness on the order of an inch or less, can be easily coiled and the subsequent passes through the twin mill stands 16 and 18 are taken by passing the strip back and forth between the coiler furnaces 20 and 22. The use of the second mill stand 18 not only increases productivity over a single mill stand, but also improves efficiency by providing an additional source for tensioning, which is particularly relevant as the thinner gauge hot mill bands are rolled.

Generally, a coil is formed on the upstream coiler 20 prior to the last pass through each of the mill stands 16 and 18. Following the last pass through each of the mill stands 16 and 18, the coil, which is now reduced to the desired thickness, enters the finishing unit 26. The finishing unit can either be a down coiler, a cut-to-length line or an appropriate shear and cooling bed crossover for the handling of plate product. Conventional equipment, such as crop shears, scale breakers, cooling sprays and the like is obviously present but is not shown in the schematic drawing.

In order to support the unique operation of the twin stand hot reversing mill 10, a sophisticated control strategy incorporating specialized software and hardware components has been developed to control the operation of the mill 10. Dependent upon the rolling parameters required for a particular product, the control system will first calculate the rolling schedule for that product empirically. Then as the band is being processed from pass to pass, the control system will recalculate the rolling schedule for each subsequent pass based on the actual data acquired during the rolling process. This recalculation will maximize the operation of the twin stand mill 10 based on the actual temperature characteristics and gauge of the band as it exits the second mill stand 16 or 18 for that particular pass. This recalculation will reset the speed and the roll gap settings for each mill stand 16 and 18, predicated on which mill stand 16 or 18 is now the first stand and which mill stand 16 or 18 is now the second stand which alternates with each pass. The key to the operation of the mill 10 is that the new operating parameters, as calculated by the control system, will determine the maximum speed each mill stand 16 and 18 can operate at, taking into consideration the percent of reduction required in each mill stand 16 and 18, mass flow of the hot band between mill stands 16 and 18, required band temperature, and the amount of horsepower/torque per mill stand 16 or 18, which will vary with each pass as the thickness of the band is reduced. Further to providing the operational parameters for the mill 10, the speed at which this calculating process takes place is critical, in that, any type of delay can effect the properties, quality and the production rate for any particular product being produced on the mill 10.

The utilization of the twin stand hot mill has been projected to produce 1,295,000 tons annually of the product mix set forth in Table I.

TABLE I

PRODUCT MIX

| Steel Grade | Tons | Gauge (in) | Width (in) |
|---|---|---|---|
| AISI 1002–1008 | 465,000 | .040–.375 | 30–62 |
| AISI 1009–1018 | 185,000 | .040–.375 | 30–62 |
| AISI 1019–1050 | 170,000 | .040–.375 | 30–62 |
| AISI 1051–1095 | 205,000 | .061–.375 | 30–62 |
| HSLA | 95,000 | .061–.375 | 30–62 |
| 409 Stainless Steel | 70,000 | .060–.375 | 37–62 |
| 304 Stainless Steel | 45,000 | .060–.250 | 37–62 |
| 316 Stainless Steel | 25,000 | .091–.375 | 37–62 |
| Silicon Steel | 35,000 | .060–.126 | 37–55 |
| Total | 1,295,000 | | |

This product mix is produced from a mix of slab thicknesses ranging from 5.5 inches to 10.0 inches. Such a slab mix can be supplied from on site steelmaking facilities, toll production or purchased slabs.

The use of the twin stand hot reversing mill results in production rates of generally 190 tons per hour, and greater, depending upon the finish gauge and width.

The above description will be clarified in the following examples. The following computer simulated examples illustrate three different sized slabs all being hot rolled on the twin stand mill 10.

EXAMPLE I

A 5½ inch thick slab 37 inches wide of high carbon AISI 1051-1095 steel is reduced to a hot mill band of 0.060 inches in a series of ten passes. Coiling begins on the upstream coiler after the fourth pass.

TABLE II 18.500 tons 1000. PIW

Rolling Schedule HSM - 37.00 - 5.500/ .0600

| Pass No. | Mill Stand Name | Gauge in. | % Red | Draft in. | Bite Angle Deg. | Length ft. | Mill Speed FPM Thread | Mill Speed FPM Roll | Strip Speed FPM Front | Strip Speed FPM Body | Roll Time sec. | Delay Time sec. | Elapsed Time sec. |
|---|---|---|---|---|---|---|---|---|---|---|---|---|---|
| 0 | FCE: | 5.5000 | .0 | .000 | .00 | 53.5 | .0 | .0 | .0 | .0 | .00 | .00 | .00 |
| 1 | TF1: | 3.9350 | 28.5 | 1.565 | 17.99 | 74.8 | 336.2 | 512.3 | 336.2 | 512.3 | 8.76 | .00 | 8.76 |
| 2 | TF2: | 2.5200 | 36.0 | 1.415 | 17.10 | 116.9 | 525.0 | 800.0 | 525.0 | 800.0 | 8.76 | 3.00 | 14.98 |
| 3 | TF2: | 1.5250 | 39.5 | .995 | 14.33 | 193.1 | 309.8 | 737.7 | 737.7 | 309.8 | 25.71 | .00 | 40.68 |
| 4 | TF1: | .9000 | 41.0 | .625 | 11.34 | 327.2 | 525.0 | 1250.0 | 1250.0 | 525.0 | 23.69 | 3.00 | 45.15 |
| 5 | TF1: | .4750 | 47.2 | .425 | 9.35 | 619.9 | 273.0 | 1040.0 | 273.0 | 1040.0 | 50.76 | .00 | 95.91 |
| 6 | TF2: | .2470 | 48.0 | .228 | 6.84 | 1192.2 | 525.0 | 2000.0 | 525.0 | 2000.0 | 47.84 | 3.00 | 99.95 |
| 7 | TF2: | .1420 | 42.5 | .105 | 4.64 | 2073.7 | 342.0 | 1628.5 | 1628.5 | 342.0 | 93.34 | .00 | 193.28 |
| 8 | TF1: | .0925 | 34.9 | .050 | 3.19 | 3183.5 | 525.0 | 2500.0 | 2500.0 | 525.0 | 90.84 | 3.00. | 196.95 |
| 9 | TF1: | .0690 | 25.4 | .024 | 2.20 | 4267.7 | 456.5 | 2173.9 | 456.5 | 2173.9 | 120.15 | .00 | 317.10 |
| 10 | TF2: | .0600 | 13.0 | .009 | 1.36 | 4907.8 | 525.0 | 2500.0 | 525.0 | 2500.0 | 117.79 | .00 | 317.10 |

| Mill Stand Name | Gauge in. | Entry Temp. Deg. F | Exit Temp. Deg. F | Roll Force lb × 10**6 | Torque lb-ft × 10**6 | Horse Power | Load Ratio | RMS Time sec. |
|---|---|---|---|---|---|---|---|---|
| FCE: | 5.5000 | 2250.00 | 2250.00 | .0000 | .0000 | 0. | .0000 | .00 |
| TF1: | 3.9350 | 2218.77 | 2213.86 | 2.6062 | 1.0802 | 12578. | 1.8360 | 29.54 |
| TF2: | 2.5200 | 2210.34 | 2219.73 | 2.9032 | 1.1425 | 20773. | 1.9419 | 33.05 |
| TF2: | 1.5250 | 2170.17 | 2164.92 | 3.0640 | 1.0080 | 16901. | 1.7133 | 75.47 |
| TF1: | .9000 | 2151.90 | 2167.15 | 2.9209 | .7575 | 21520. | 1.5371 | 55.96 |
| TF1: | .4750 | 2131.18 | 2150.47 | 3.2585 | .6902 | 16315. | 1.1732 | 69.86 |
| TF2: | .2470 | 2138.61 | 2162.57 | 3.1644 | .4810 | 21866. | 1.5619 | 116.71 |
| TF2: | .1420 | 2088.70 | 2102.68 | 3.0025 | .2980 | 11030. | .7879 | 57.94 |
| TF1: | .0925 | 1999.91 | 2012.92 | 2.9099 | .1867 | 10610. | .7579 | 52.18 |
| TF1: | .0690 | 1920.02 | 1919.28 | 2.6649 | .1088 | 5378. | .3841 | 17.73 |

TABLE II-continued 18.500 tons 1000. PIW
Rolling Schedule HSM - 37.00 - 5.500/ .0600

| | | | | | | | | |
|---|---|---|---|---|---|---|---|---|
| TF2: | .0600 | 1893.00 | 1875.83 | 1.6542 | .0384 | 2180. | .1557 | 2.86 |

| | |
|---|---|
| Reversing Tandem Mill RMS Production: | 210.03 TPH |
| Reversing Tandem Mill Peak Production: | 210.03 TPH |
| Coiling begins at Pass Number: | 4 TF1 |
| Tandem Passes begin at Pass Number: | 1 TF1 |
| Distance Between Cfce #1 and Mill: | 35.00 ft. |
| Distance Between Mill and Cfce #2: | 35.00 ft. |

EXAMPLE II

A 7 inch thick, 48 inch wide slab of AISI Type 304 stainless steel is reduced to 0.070 gauge in twelve passes. Coiling of the intermediate product begins at the conclusion of the sixth pass in the upstream coiler.

TABLE III 24.596 tons 1025. PIW
Rolling Schedule HSM - 48.00 - 7.0000/ .0700

| Pass | Mill Stand | Gauge | % | Draft | Bite Angle | Length | Mill Speed FPM | | Strip Speed FPM | | Roll Time | Delay Time | Elapsed Time |
|---|---|---|---|---|---|---|---|---|---|---|---|---|---|
| No. | Name | in. | Red | in. | Deg. | ft. | Thread | Roll | Front | Body | sec. | sec. | sec. |
| 0 | FCE: | 7.0000 | .0 | 0.000 | .00 | 42.1 | .0 | .0 | .0 | .0 | .00 | .00 | .00 |
| 1 | TF1: | 5.8500 | 16.41 | .150 | 15.41 | 50.3 | 412.8 | 511.1 | 412.8 | 511.1 | 5.91 | .00 | 5.91 |
| 2 | TF2: | 4.6000 | 21.4 | 1.250 | 16.07 | 64.0 | 525.0 | 650.0 | 525.0 | 650.0 | 5.91 | 3.00 | 11.53 |
| 3 | TF2: | 3.4000 | 26.1 | 1.200 | 15.74 | 86.6 | 359.8 | 548.2 | 548.2 | 359.8 | 9.48 | .00 | 21.00 |
| 4 | TF1: | 2.3300 | 31.5 | 1.070 | 14.86 | 126.4 | 525.0 | 800.0 | 800.0 | 525.0 | 9.48 | 3.00 | 27.01 |
| 5 | TF1: | 1.6250 | 30.3 | .705 | 12.05 | 181.2 | 313.4 | 626.8 | 313.4 | 626.8 | 25.70 | .00 | 52.70 |
| 6 | TF2: | .9700 | 40.3 | .655 | 11.61 | 303.6 | 525.0 | 1050.0 | 525.0 | 1050.0 | 23.97 | 3.00 | 57.43 |
| 7 | TF2: | .5450 | 43.8 | .425 | 9.35 | 540.3 | 269.7 | 642.2 | 642.2 | 269.7 | 60.79 | .00 | 118.21 |
| 8 | TF1: | .2800 | 48.6 | .265 | 7.38 | 1051.8 | 525.0 | 1250.0 | 1250.0 | 525.0 | 58.47 | 3.00 | 122.90 |
| 9 | TF1: | .1527 | 45.5 | .127 | 5.11 | 1928.6 | 367.5 | 1400.1 | 367.5 | 1400.1 | 96.89 | .00 | 219.78 |
| 10 | TF2: | .1069 | 30.0 | .046 | 3.07 | 2754.8 | 525.0 | 2000.0 | 525.0 | 2000.0 | 94.72 | 3.00 | 223.55 |
| 11 | TF2: | .0825 | 22.8 | .024 | 2.24 | 3569.6 | 445.5 | 2121.2 | 2121.2 | 445.5 | 117.32 | .00 | 340.88 |
| 12 | TF1: | .0700 | 15.2 | .013 | 1.60 | 4207.0 | 525.0 | 2500.0 | 2500.0 | 525.0 | 115.41 | 3.00 | 344.39 |

| Mill Stand Name | Gauge in. | Entry Temp. Deg. F | Exit Temp. Deg. F | Roll Force lb × 10**6 | Torque lb-ft × 10**6 | Horse Power | Load Ratio | RMS Time sec. |
|---|---|---|---|---|---|---|---|---|
| FCE: | 7.0000 | 2250.00 | 2250.00 | .0000 | .0000 | 0. | .0000 | .00 |
| TF1: | 5.8500 | 2225.76 | 2220.18 | 2.6948 | 1.2945 | 15038. | 2.2004 | 28.61 |
| TF2: | 4.6000 | 2217.64 | 2219.82 | 2.8119 | 1.3201 | 19502. | 2.2438 | 29.75 |
| TF2: | 3.4000 | 2204.01 | 2196.48 | 3.0226 | 1.3178 | 16420. | 2.2399 | 47.56 |
| TF1: | 2.3300 | 2190.77 | 2196.72 | 3.3121 | 1.2929 | 23508. | 2.1976 | 45.78 |
| TF1: | 1.6250 | 2100.01 | 2089.67 | 3.9770 | 1.2686 | 18072. | 2.1564 | 119.49 |
| TF2: | .9700 | 2084.05 | 2101.49 | 4.8244 | 1.2755 | 30440. | 2.1743 | 113.34 |
| TF2: | .5450 | 2058.06 | 2074.48 | 5.3385 | 1.1238 | 16403. | 1.9101 | 221.78 |
| TF1: | .2800 | 2038.23 | 2063.77 | 6.0436 | .9815 | 27885. | 1.9918 | 231.94 |
| TF1: | .1527 | 1988.20 | 2008.94 | 6.5193 | .6983 | 22221. | 1.5872 | 244.08 |
| TF2: | .1069 | 1986.44 | 1992.88 | 4.7014 | .2783 | 12651. | .9036 | 77.34 |
| TF2: | .0825 | 1904.54 | 1905.01 | 4.7312 | .1872 | 9027. | .6448 | 48.78 |
| TF1: | .0700 | 1802.94 | 1799.37 | 4.4714 | .1126 | 6396. | .4569 | 24.09 |

| | |
|---|---|
| Reversing Tandem Mill RMS Production: | 121.66 TPH |
| Reversing Tandem Mill Peak Production: | 190.68 TPH |
| Coiling begins at Pass Number: | 6 TF2 |
| Tandem Passes begin at Pass Number: | 1 TF1 |
| Distance Between Cfce #1 and Mill: | 35.00 ft. |
| Distance Between Mill and Cfce #2: | 35.00 ft. |

EXAMPLE III

A 10 inch thick, 48 inch wide slab of AISI Type 1095 carbon steel is reduced to a 0.0910 inch coil in fourteen passes with coiling beginning following the eighth flat pass.

TABLE IV 24.003 tons 1000. PIW
Rolling Schedule HSM - 48.00 - 10.0000/ .1185

| Pass No. | Mill Stand Name | Gauge in. | % Red | Draft in. | Bite Angle Deg. | Length ft. | Mill Speed FPM Thread | Mill Speed FPM Roll | Strip Speed FPM Front | Strip Speed FPM Body | Roll Time sec. | Delay Time sec. | Elapsed Time sec. |
|---|---|---|---|---|---|---|---|---|---|---|---|---|---|
| 0 | FCE: | 10.0000 | .0 | .000 | .00 | 29.5 | .0 | .0 | .0 | .0 | .00 | .00 | .00 |
| 1 | TF1: | 8.7000 | 13.0 | 1.300 | 16.39 | 33.9 | 446.6 | 510.3 | 446.6 | 510.3 | 3.98 | .00 | 3.98 |
| 2 | TF2: | 7.4000 | 14.9 | 1.300 | 16.39 | 39.8 | 525.0 | 600.0 | 525.0 | 600.0 | 3.98 | 3.00 | 9.40 |
| 3 | TF2: | 6.1000 | 17.6 | 1.300 | 16.39 | 48.3 | 413.1 | 472.1 | 472.1 | 413.1 | 6.14 | .00 | 15.53 |
| 4 | TF1: | 4.8000 | 21.3 | 1.300 | 16.39 | 61.4 | 525.0 | 600.0 | 600.0 | 525.0 | 6.14 | 3.00 | 21.15 |
| 5 | TFI: | 3.5500 | 26.0 | 1.250 | 16.07 | 83.0 | 369.7 | 739.4 | 369.7 | 739.4 | 6.73 | .00 | 27.88 |
| 6 | TF2: | 2.5000 | 29.6 | 1.050 | 14.72 | 117.8 | 525.0 | 1050.0 | 525.0 | 1050.0 | 6.73 | 3.00 | 33.80 |
| 7 | TF2: | 1.5300 | 38.8 | .970 | 14.14 | 192.5 | 308.8 | 617.6 | 617.6 | 308.8 | 27.07 | .00 | 60.87 |
| 8 | TF1: | .9000 | 41.2 | .630 | 11.39 | 327.2 | 525.0 | 1050.0 | 1050.0 | 525.0 | 25.32 | 3.00 | 65.62 |
| 9 | TF1: | .4900 | 45.6 | .410 | 9.18 | 601.0 | 283.9 | 838.3 | 283.9 | 838.3 | 55.28 | .00 | 120.90 |
| 10 | TF2: | .2650 | 45.9 | .225 | 6.80 | 1111.3 | 525.0 | 1550.0 | 525.0 | 1550.0 | 52.76 | 3.00 | 125.19 |
| 11 | TF2: | .1550 | 41.5 | .110 | 4.75 | 1900.0 | 401.4 | 1414.4 | 1414.4 | 401.4 | 93.86 | .00 | 219.05 |
| 12 | TF1: | .1185 | 23.5 | .036 | 2.74 | 2485.2 | 525.0 | 1850.0 | 1850.0 | 525.0 | 91.93 | 3.00 | 222.81 |
| 13 | TF1: | .1000 | 15.6 | .019 | 1.95 | 2945.0 | 477.7 | 1683.5 | 477.7 | 1683.5 | 107.22 | .00 | 330.03 |
| 14 | TF2: | .0910 | 9.0 | .009 | 1.36 | 3236.3 | 525.0 | 1850.0 | 525.0 | 1850.0 | 104.96 | .00 | 330.03 |

| Mill Stand Name | Gauge in. | Entry Temp. Deg. F | Exit Temp. Deg. F | Roll Force lb × 10**6 | Torque lb-ft × 10**6 | Horse Power | Load Ratio | RMS Time sec. |
|---|---|---|---|---|---|---|---|---|
| FCE: | 10.0000 | 2250.00 | 2250.00 | .0000 | .0000 | 0. | .0000 | .00 |
| TF1: | 8.7000 | 2233.52 | 2230.65 | 2.9455 | 1.1122 | 12901. | 1.8905 | 14.22 |
| TF2: | 7.4000 | 2228.90 | 2231.02 | 2.9444 | 1.1118 | 15162. | 1.8898 | 14.21 |
| TF2: | 6.1000 | 2223.40 | 2218.64 | 2.9807 | 1.1255 | 12077. | 1.9131 | 22.45 |
| TF1: | 4.8000 | 2215.76 | 2218.92 | 2.9799 | 1.1252 | 15344. | 1.9125 | 22.44 |
| TF1: | 3.5500 | 2197.47 | 2194.82 | 3.0996 | 1.1473 | 19281. | 1.9501 | 25.60 |
| TF2: | 2.5000 | 2192.27 | 2199.25 | 3.1747 | 1.0753 | 25662. | 1.8330 | 22.62 |
| TF2: | 1.5300 | 2152.23 | 2162.99 | 3.9125 | 1.2708 | 17839. | 2.1600 | 126.39 |
| TF1: | .9000 | 2150.13 | 2164.66 | 3.8200 | .9946 | 23736. | 1.6954 | 72.79 |
| TF1: | .4900 | 2122.20 | 2138.42 | 4.1219 | .8576 | 16340. | 1.4577 | 117.47 |
| TF2: | .2650 | 2124.48 | 2144.50 | 3.9851 | .6028 | 21235. | 1.5168 | 121.39 |
| TF2: | .1550 | 2066.25 | 2079.02 | 3.8870 | .3972 | 12769. | .9121 | 78.08 |
| TF1: | .1185 | 2000.17 | 1996.30 | 2.4799 | .1389 | 5842. | .4173 | 16.01 |
| TF1: | .1000 | 1910.11 | 1896.43 | 2.0006 | .0766 | 2931. | .2094 | 4.70 |
| TF2: | .0910 | 1873.84 | 1853.88 | 1.3299 | .0342 | 1436. | .1026 | 1.11 |

| | | | |
|---|---|---|---|
| Distance Between Mill and Cfce #2: | 35.00 ft. | Coiling begins at Pass Number: | 8 TF1 |
| Reversing Tandem Mill RMS Production: | 220.01 TPH | Tandem Passes begin at Pass Number: | 1 TF1 |
| Reversing Tandem Mill Peak Production: | 261.83 TPH | Distance Between Cfce #1 and Mill: | 35.00 ft. |

Having thus described the invention in the detail and particularity required by the Patent Laws, what is desired protected by Letters Patent is set forth in the following claims.

We claim:

1. In a method of hot rolling steel slabs of thin to standard thickness into hot mill band on a hot mill having a coiler furnace upstream and downstream of a reversing mill, the improvement comprising utilizing a twin stand hot reversing mill and:

a) introducing a slab directly into a first stand of said mill without any breakdown pass;

b) flat tandem passing said slab back and forth through said first stand and a second stand to form an intermediate product having a thickness on the other of an inch or less capable of being coiled;

c) coiling said intermediate product on one of said upstream or downstream coiling furnaces;

d) passing said intermediate product back and forth between said first and second stand in tandem while coiling and decoiling in said upstream and downstream coiler furnaces to form a hot mill band of the desired thickness; and e) removing said hot mill band in one of sheet, plate or coil form from said hot mill.

2. The improvement of claim 1 including utilizing a vertical edger located between the first and second stand and subjecting the intermediate product to edging passes during at least said flat passes.

3. The improvement of claim 1 including producing in excess of 1 million tons annually at a production rate of generally 190 tons per hour and greater.

4. The improvement of claim 1 including producing a product mix of carbon, high strength low alloy, stainless and silicon steels.

5. The method of claim 1 including taking 10 to 14 passes to achieve the hot mill band.

6. The method of claim 1 including 4 to 8 flat passes.

* * * * *